US006921240B2

(12) United States Patent
Moore

(10) Patent No.: US 6,921,240 B2
(45) Date of Patent: Jul. 26, 2005

(54) INDUSTRIAL ROLL HANDLING APPARATUS

(76) Inventor: Kevin E. Moore, 12 Angott Rd., Washington, PA (US) 15301

( * ) Notice: Subject to any disclaimer, the term of this patent is extended or adjusted under 35 U.S.C. 154(b) by 284 days.

(21) Appl. No.: 10/050,234

(22) Filed: Jan. 16, 2002

(65) Prior Publication Data

US 2003/0133777 A1 Jul. 17, 2003

(51) Int. Cl.[7] ..... B66F 1/00
(52) U.S. Cl. ..... 414/607; 414/620; 414/911
(58) Field of Search ..... 414/419, 420, 414/448, 449, 607, 620, 641, 911, 427; 29/273; 254/4 R

(56) References Cited

U.S. PATENT DOCUMENTS

| | | | | | |
|---|---|---|---|---|---|
| 2,664,215 | A | | 12/1953 | Bottenhorn | |
| 2,959,444 | A | | 11/1960 | Callender | |
| 3,587,892 | A | * | 6/1971 | Vermette | 414/641 |
| 3,616,578 | A | | 11/1971 | Clark, Jr. | |
| 3,847,709 | A | | 11/1974 | Martin | |
| 4,144,981 | A | * | 3/1979 | Borgen | 414/607 |
| 4,618,306 | A | * | 10/1986 | Dorsch | 414/607 |
| 4,684,310 | A | * | 8/1987 | Stange | 414/620 |
| 4,692,084 | A | * | 9/1987 | Persson | 414/607 |
| 4,921,389 | A | * | 5/1990 | O'Daniel | 414/420 |
| 5,020,963 | A | * | 6/1991 | Okada | 414/607 |
| 5,207,550 | A | * | 5/1993 | Lehman | 414/607 |
| 5,257,890 | A | * | 11/1993 | Vickary | 414/420 |
| 5,344,278 | A | * | 9/1994 | Emig, Jr. | 414/622 |
| 5,513,944 | A | | 5/1996 | Cullen et al. | |
| 5,642,979 | A | | 7/1997 | Cullen et al. | |
| 5,944,474 | A | * | 8/1999 | Cummins et al. | 414/911 |
| 5,947,407 | A | | 9/1999 | Quigley | |
| 5,975,826 | A | | 11/1999 | Scholder | |

* cited by examiner

*Primary Examiner*—Paul Chin

(57) ABSTRACT

An industrial roll handling apparatus allows the user to lift and maneuver industrial rolls and other heavy objects without the aid of another individual. It is removably attached to a forklift or tow motor for maneuverability. It has a triangular truss body that provides strength and support and a barrel within a barrel system that allows an industrial roll to turn independently from the truss. Straps used in combination with a buckle fastening system secure the industrial roll to the apparatus. Once fastened, the industrial roll can be manually rotated in a complete circle.

6 Claims, 5 Drawing Sheets

INDUSTRIAL ROLL HANDLING APPARATUS

RELATED APPLICATIONS

None

FIELD OF THE INVENTION

The present invention relates generally to industrial roll handling devices. More specifically, the present invention relates to a device that can easily maneuver and turn an industrial roll of material.

BACKGROUND OF THE INVENTION

It is often necessary in an industrial setting for an individual to handle, move, turn or otherwise maneuver a large roll of material. Often these rolls weigh between three hundred and eight hundred pounds making it extremely difficult for an individual to maneuver said rolls alone. Consequently, the need exists for an apparatus that allows an individual to maneuver heavy rolls of material alone. The present invention fulfills this need.

Several patents have issued that address the subject of roll handling. U.S. Pat. No. 5,947,407 issued in the name of Quigley discloses an in-line automated roll stand. U.S. Pat. No. 3,847,709 issued in the name of Martin also discloses a roll stand. Although portable, neither the invention disclosed in the '407 Patent, nor the invention disclosed in the '709 Patent allow an individual to move an industrial roll from one place to another. The devices disclosed therein merely hold the roll, automatically or manually lift the roll up off of the floor and turn the roll, but cannot transport the roll. The present invention allows a single person to not only lift a roll up off of the floor, but also turn the roll and move the roll from one place to another when used in combination with a forklift or tow motor.

U.S. Pat. No. 5,642,979 issued to Cullen et al., discloses a roll handling apparatus for fork lift trucks. The device disclosed therein utilizes a hoist cable system to lift the industrial roll and relies on a gripper system to hold the heavy roll. The present invention uses a strapping system in lieu of a gripper system to hold the industrial roll. The strapping system more completely retains the roll. Also, the present invention uses its body together with the body of the forklift in lieu of a cable system to more securely lift the industrial roll.

SUMMARY OF THE INVENTION

The industrial roll handling apparatus that is disclosed herein is a device used to move, turn and otherwise maneuver heavy rolls of industrial material. It allows a single individual alone to maneuver the rolls. The industrial roll handling apparatus has attachment legs that receive the tines of a forklift or tow motor. The industrial roll handling apparatus also has a triangular truss body that provides strength and support to the apparatus. Attached to the truss is a barrel within a barrel system that allows an industrial roll to turn independently from the truss. Straps used in combination with a buckle fastening system secure the industrial roll to the apparatus. Once the roll is securely fastened within the straps, the fork lift or tow motor can lift the apparatus/roll combination and move the roll to its intended destination. Also, the industrial roll can now be manually rotated in a complete circle allowing the roll to be turned from vertical to horizontal if necessary for use thereof.

It is an object of the present invention to provide an apparatus that can easily lift, move, turn and otherwise maneuver heavy industrial rolls of material with the use of a forklift or tow motor.

It is a further object of the present invention to provide an apparatus that can easily lift, move, turn and otherwise maneuver heavy industrial rolls of material and requires only one individual operator.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
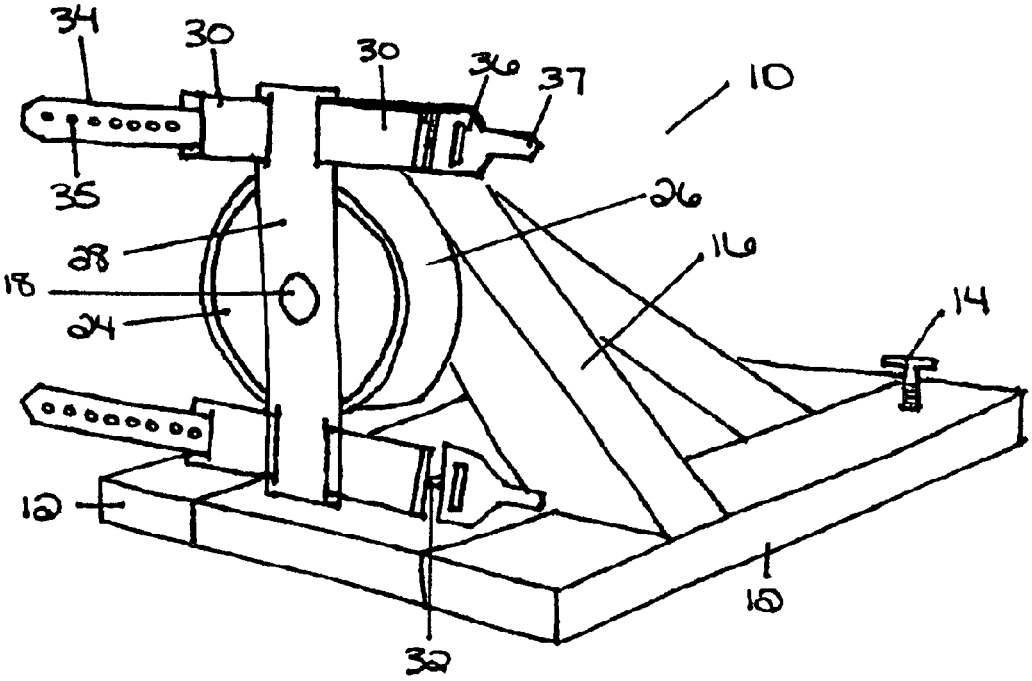
FIG. 1 is a perspective view of the apparatus for lifting and moving rolls of industrial material for use with a forklift or tow motor.
Figure 2:
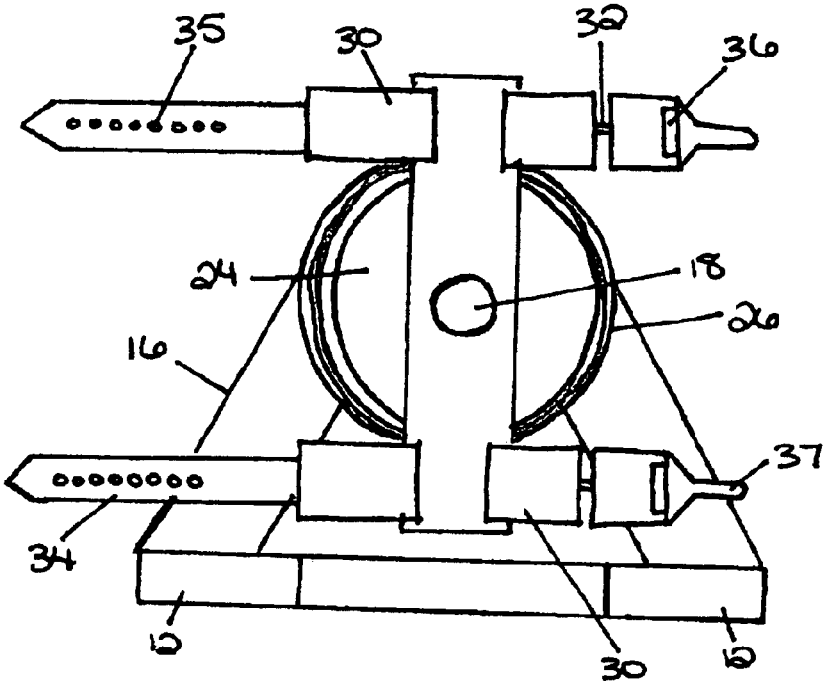
FIG. 2 is a front view of the apparatus for lifting and moving rolls of industrial material for use with a forklift or tow motor.
Figure 3:
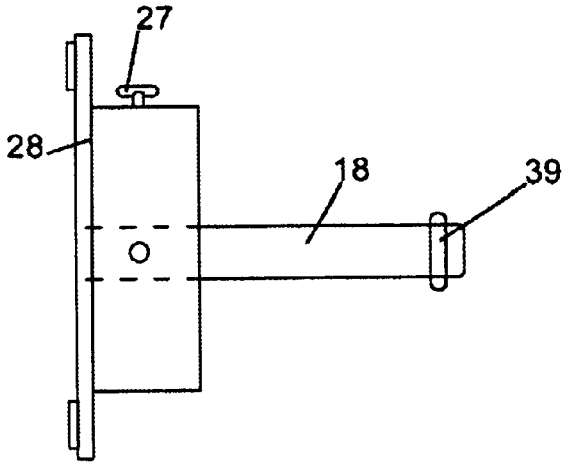
FIG. 3 is a side view of the apparatus for lifting and moving rolls of industrial material for use with a forklift or tow motor without the truss.
Figure 4:
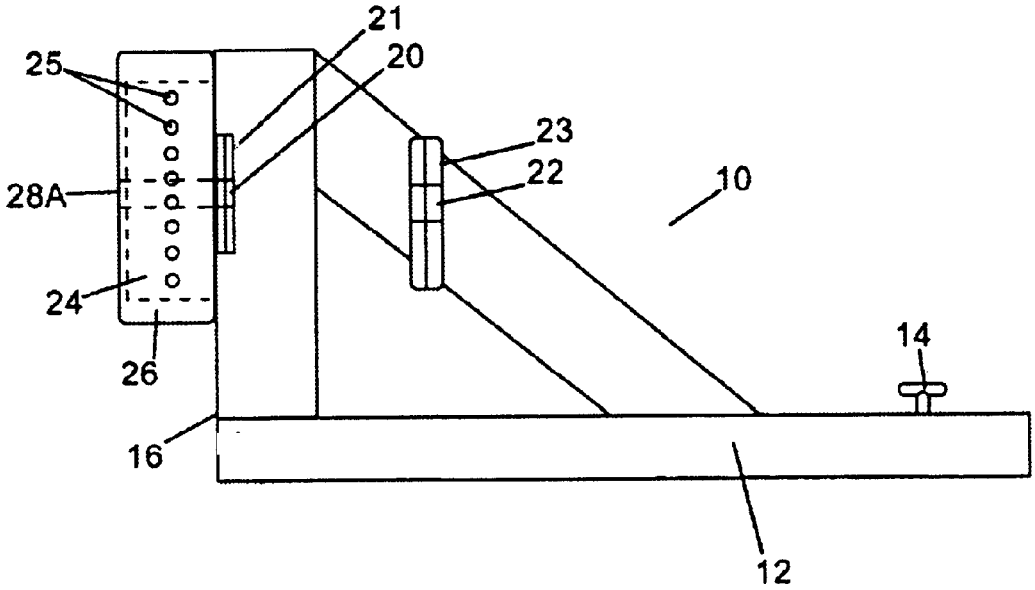
FIG. 4 is a side view of the apparatus for lifting and moving rolls of industrial material for use with a forklift or tow motor.
Figure 5:
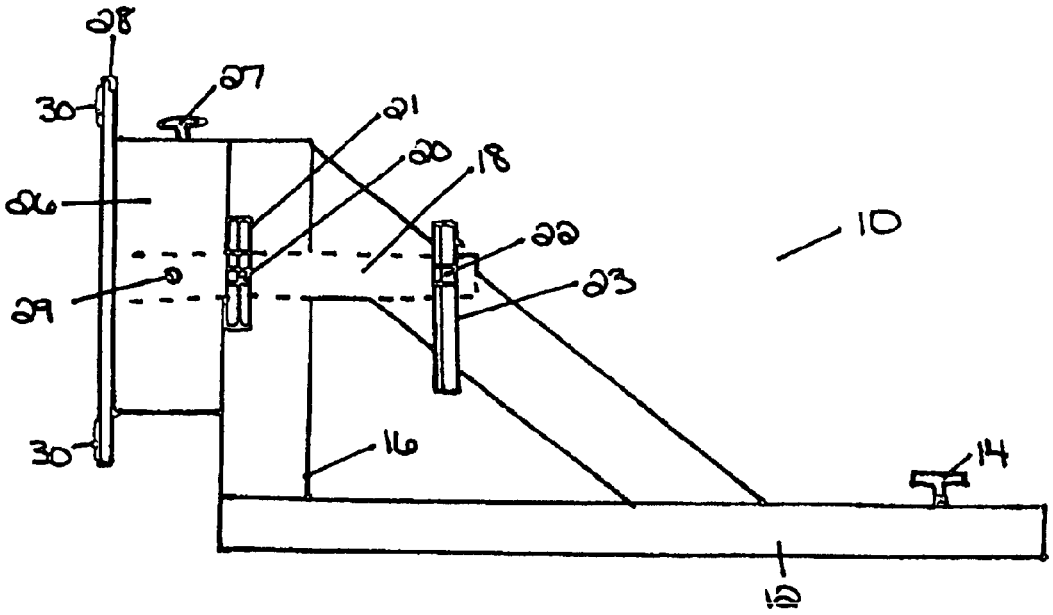
FIG. 5 is a side view of the apparatus for lifting and moving rolls of industrial material for use with a forklift or tow motor.
Figure 6:
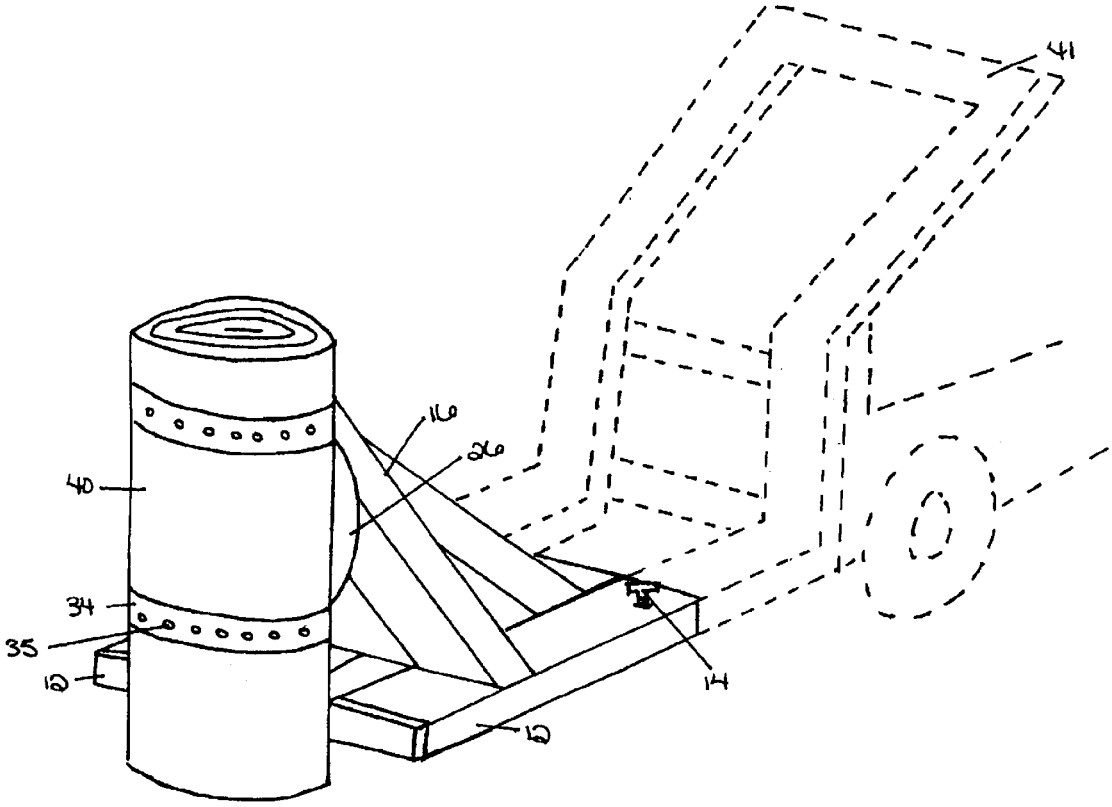
FIG. 6 is a perspective view of the apparatus for lifting and moving rolls of industrial material for use with a forklift or tow motor in use.

The preferred embodiment of the present invention, the apparatus for lilting and moving rolls of industrial material for use with a forklift or tow motor 10 is shown in FIGs. 1–6. As seen in FIGS 1 and 5, the preferred embodiment of the apparatus for lifting and moving rolls of industrial material for use with a forklift or tow motor 10 has attachment legs 12 that receive the tines of a fork lift or tow motor allowing the apparatus for lifting and moving rolls of industrial material for use with a forklift or tow motor 10 to be maneuvered by the same. A "T" handle pin 14 is used to lock the attachment legs 12 to the fork lift or tow motor. A triangular truss 16 preferably forms the main body of the apparatus for lifting and moving rolls of industrial material for use with a forklift or tow motor 10. It gives the apparatus 10 the strength needed to support heavy industrial rolls of material 40 as seen in FIG. 6 Traveling through the truss 16, as illustrated in the side view of the apparatus for lifting and moving rolls of industrial material for use with a forklift or tow motor 10 shown in FIGS. 3 and 5, is an axle 18. The axle 18 is situated within the arms of the truss 16 such that it can freely rotate three hundred and sixty degrees. Front and back bearings 20, 22 placed between the arms of the truss 16 allow the axle 18 to turn freely. The front and back bearings are kept in place by concealment plates 21, 23 that hold front bearing casing 20 and rear bearing casing 22. A collar 39 is attached to the end of the axle 18 to keep it in place. One of ordinary skill in the art would readily recognize that other methods can be used to keep the bearings 20, 22 in position. In the preferred embodiment, an inner barrel 24 attached to the face of the truss 16. The inner barrel 24 does not rotate and is kept stationary in position with the truss 16. Surrounding the inner barrel 24, in the preferred embodiment, is an outer barrel 26 that does rotate.

In the preferred embodiment, the outer barrel 26 has a single aperture 29 located on its outer circumference. The inner barrel 24 has several apertures 25 therethrough that are evenly spaced around its circumference. The apertures 25 are sized such that pins 27 can be inserted partially therethrough. The pins 27 work to keep the outer barrel 26 stationary with the inner barrel 24 when necessary. As the outer barrel 26 rotates, a different pair of apertures 25 and 29 are constantly being aligned.

Attached to the face of the outer barrel 26, in the preferred embodiment, is a plate 28, most clearly viewed in FIGs. 1 and 2. The plate 28 serves as a backbone to any industrial rolls being fastened thereto. The axle 18 is attached to the plate 28 through an aperture 28A and the plate 28 is attached to the outer barrel 26, such that when the plate 28 and any roll 40 attached thereto is manually rotated by the user, both the axle 18 and the outer barrel 26 turn with the plate 28.

In the preferred embodiment, four rectangular metal partitions 30 are hinged to the plate 28. The metal partitions 30 are preferably positioned such that they stem from the sides of the plate 28 when the plate 28 is positioned vertically with the ground, with two partitions 30 stemming off of one side of the plate 28 and two partitions 30 stemming off of the opposite side of the plate, one each at the top and bottom of each side. Attached to each of the two metal partitions 30 positioned on one side of the plate 28 are threaded bolts 32. The threaded bolts 32 are used for fine adjustments of the tightness of the straps 34 used to secure the industrial rolls 40 to the apparatus for lifting and moving rolls of industrial material for use with a forklift or tow motor 10. Attached to each of the two metal partitions 30 positioned on the opposite side of the plate 28 are straps 34. The straps 34 are preferably constructed from leather, although one of ordinary skill in the art would readily recognize that a number of other materials, including, but not limited to, nylon, can be used to construct the straps 34. Screwed onto the threaded bolts 32 are buckle mechanisms 36 for receiving the straps 34. Each of the buckle mechanisms 36 of the preferred embodiment, have a notch 38 for inserting through the nearest aperture 35 in the straps 34 after the straps 34 have been wrapped around an industrial roll 40 or when the apparatus 10 is empty. The buckle mechanism 36 of the preferred embodiment also has a handle 37 for tightening the hold of the straps 34 after the notch 38 has been secured. The handle 37 is flipped to its opposite position pulling the straps 34 tighter than just the notch 38 alone. One of ordinary skill in the art would readily recognize that a different means for securing the straps 34 other than the buckle mechanism 36 described herein can be used to secure the industrial roll of material 40 to the apparatus for lifting and moving rolls of industrial material for use with a forklift or tow motor 10, including, but not limited to, a simple buckle.

To secure a roll of material 40, a fork lift or tow motor is inserted and locked into the attachment legs 12 of the apparatus for lifting and moving rolls of industrial material for use with a forklift or tow motor 10, as seen in FIG. 6. Using the fork lift or tow motor, the apparatus for lifting and moving rolls of industrial material for use with a forklift or tow motor 10 is then moved to the position of the roll 40 that needs to be maneuvered. Assuming that said roll is on the ground, the apparatus for lifting and moving rolls of industrial material for use with a forklift or tow motor 10 is then placed on the ground, again using the fork lift or tow motor, as close to the roll 40 as possible. The roll 40 is then strapped to the apparatus for lifting and moving rolls of industrial material for use with a forklift or tow motor 10 using the straps 34 and the buckle mechanism 36. The roll 40 is now ready to be moved where it is needed. In an instance where the roll 40 needs to be rotated, the user merely removes the pins 27 from the barrel apertures 25 and 29 and manually rotates the roll 40 into position. Once the desired position is achieved, the user reinserts the pins 27 into the aligned barrel apertures 25 and 29 to hold that position.

Although this invention has certain preferred embodiments, it will be obvious to those skilled in the art that various changes and modifications may be made therein without departing from the invention, and all such changes and modifications are intended to fall within the true spirit and scope of the invention.

What is claimed is:

1. An apparatus for lifting and moving rolls of industrial material for use with a forklift or tow motor comprising:

a triangular truss body;

a pair of attachment legs, for matingly engaging a machine capable of lifting and moving objects, coupled to the triangular truss body;

a means for locking said attachment legs to said machine capable of lifting and moving objects;

a pair of concealment plates, coupled to the triangular truss body;

a pair of bearing casings contained within said pair of concealment plates;

an axle, said axle inserted through the triangular truss body, such that said axle passes through the center of each bearing casing;

a collar attached to the end of the axle for keeping the axle in place;

an inner barrel, said inner barrel fixedly secured to the face of the triangular truss body, said barrel having a plurality of apertures cut through the outer circumference thereof;

an outer barrel surrounding the inner barrel, such that said outer barrel is freely rotatable, said outer barrel having an aperture cut through the outer circumference thereof;

a plate coupled to the outer barrel, said plate having an aperture in the center thereof sized to fit the axle therethrough, said plate attached to the axle at said aperture such that when said plate is rotated, the axle and the outer barrel rotate therewith;

a pin, removably inserted through the aperture in the outer barrel and through one of said apertures in the inner barrel for keeping the outer barrel from turning; and, a means for securing bulk material, said means coupled to the face of the plate.

2. The apparatus for lifting and moving rolls of industrial material for use with a forklift or tow motor of claim 1 wherein said means for securing bulk material is a strap and buckle mechanism wherein said strap is wrapped around the bulk material and then secured therearound by said buckle.

3. The apparatus for lifting and moving rolls of industrial material for use with a forklift or tow motor of claim 1 wherein said means for securing bulk material is a strap and buckle mechanism wherein said strap is wrapped around the bulk material and then secured therearound by said buckle and further having a handle mechanism attached to said means for securing bulk material, said handle mechanism is flipped over once the bulk material is initially secured, for further securing the bulk material in place.

4. An apparatus for lifting and moving rolls of industrial material for use with a forklift or tow motor comprising:

a triangular truss body;

a pair of attachment legs, for matingly engaging a machine capable of lifting and moving objects, coupled to the triangular truss body;

a means for locking said attachment legs to said machine capable of lifting and moving objects;

a pair of concealment plates, coupled to the triangular truss body;

a pair of bearing casings contained within said pair of concealment plates;

an axle, said axle inserted through the triangular truss body, such that said axle passes through the center of each bearing casing;

a collar attached to the end of the axle for keeping the axle in place;

an inner barrel, said inner barrel fixedly secured to the face of the triangular truss body, said barrel having a plurality of apertures cut through the outer circumference thereof;

an outer barrel surrounding the inner barrel, such that said outer barrel is freely rotatable, said outer barrel having an aperture cut through the outer circumference thereof;

a plate coupled to the outer barrel, said plate having an aperture in the center thereof sized to fit the axle therethrough said plate attached to the axle at said aperture such that when said plate is rotated, the axle and the outer barrel rotate therewith;

a pin, removably inserted through the aperture in the outer barrel and through one of said apertures in the inner barrel for keeping the outer barrel from turning;

four metal partitions hinged to the plate; and, a means for securing bulk material, said means coupled to the four metal partitions.

5. The apparatus for lifting and moving rolls of industrial material for use with a forklift or tow motor of claim 4 wherein said means for securing bulk material is a strap and buckle mechanism wherein said strap is wrapped around the bulk material and then secured therearound by said buckle.

6. The apparatus for lifting and moving rolls of industrial material for use with a forklift or tow motor of claim 4 wherein said means for securing bulk material is a strap and buckle mechanism wherein said strap is wrapped around the bulk material and then secured therearound by said buckle and further having a handle mechanism attached to said means for securing bulk material, said handle mechanism is flipped over once the bulk material is initially secured, for further securing the bulk material in place.

* * * * *